US005169021A

United States Patent [19]

Schutz

[11] Patent Number: 5,169,021

[45] Date of Patent: Dec. 8, 1992

[54] PLASTIC LID FOR BLOW-FORMED BUNG AND WIDEMOUTHED BARRELS OF PLASTIC

[76] Inventor: Udo Schutz, Ruckersteg 4, D-5418 Selters, Fed. Rep. of Germany

[21] Appl. No.: 757,201

[22] Filed: Sep. 10, 1991

[30] Foreign Application Priority Data

Sep. 17, 1990 [DE] Fed. Rep. of Germany ..... 4029472

[51] Int. Cl.[5] ..... B65D 53/00

[52] U.S. Cl. ..... 220/521; 220/214; 220/377

[58] Field of Search ..... 220/212, 214, 288, 306, 220/356, 521, 523

[56] References Cited

U.S. PATENT DOCUMENTS

| | | | |
|---|---|---|---|
| 977,445 | 12/1910 | Fugate | 220/214 |
| 1,786,826 | 12/1930 | Cooper | 220/214 |
| 1,872,159 | 8/1932 | McCreary | 220/521 X |
| 1,879,517 | 9/1932 | Rowbotham | 220/521 X |
| 2,015,028 | 9/1935 | Gillette | 220/521 X |
| 2,120,403 | 6/1938 | Godfrey | 220/521 X |
| 2,766,796 | 10/1956 | Tupper | 220/521 |
| 3,131,827 | 5/1964 | Wheaton | 220/306 X |
| 4,724,855 | 2/1988 | Jackson et al. | 220/521 X |

FOREIGN PATENT DOCUMENTS

| | | |
|---|---|---|
| 549924 | 5/1932 | Fed. Rep. of Germany . |
| 3822860 | 1/1990 | Fed. Rep. of Germany . |

*Primary Examiner*—Stephen Marcus
*Assistant Examiner*—Nova Stucker
*Attorney, Agent, or Firm*—Young & Thompson

[57] ABSTRACT

The plastic lid (1) for blow-molded bung barrels (7) and widemouthed barrels exhibits a central, flat storage chamber (12) arranged on the outside (11) within the lid contour, for papers accompanying goods of all types and the like, with a cylindrical wall (13) formed on the outside (11) of the barrel lid (1), with a removable sealing lid (14) of plastic, as well as with a blind bung (15) formed centrally at the barrel lid (1) for centering and supporting the chamber lid (14).

10 Claims, 2 Drawing Sheets

PLASTIC LID FOR BLOW-FORMED BUNG AND WIDEMOUTHED BARRELS OF PLASTIC

Figure 1:
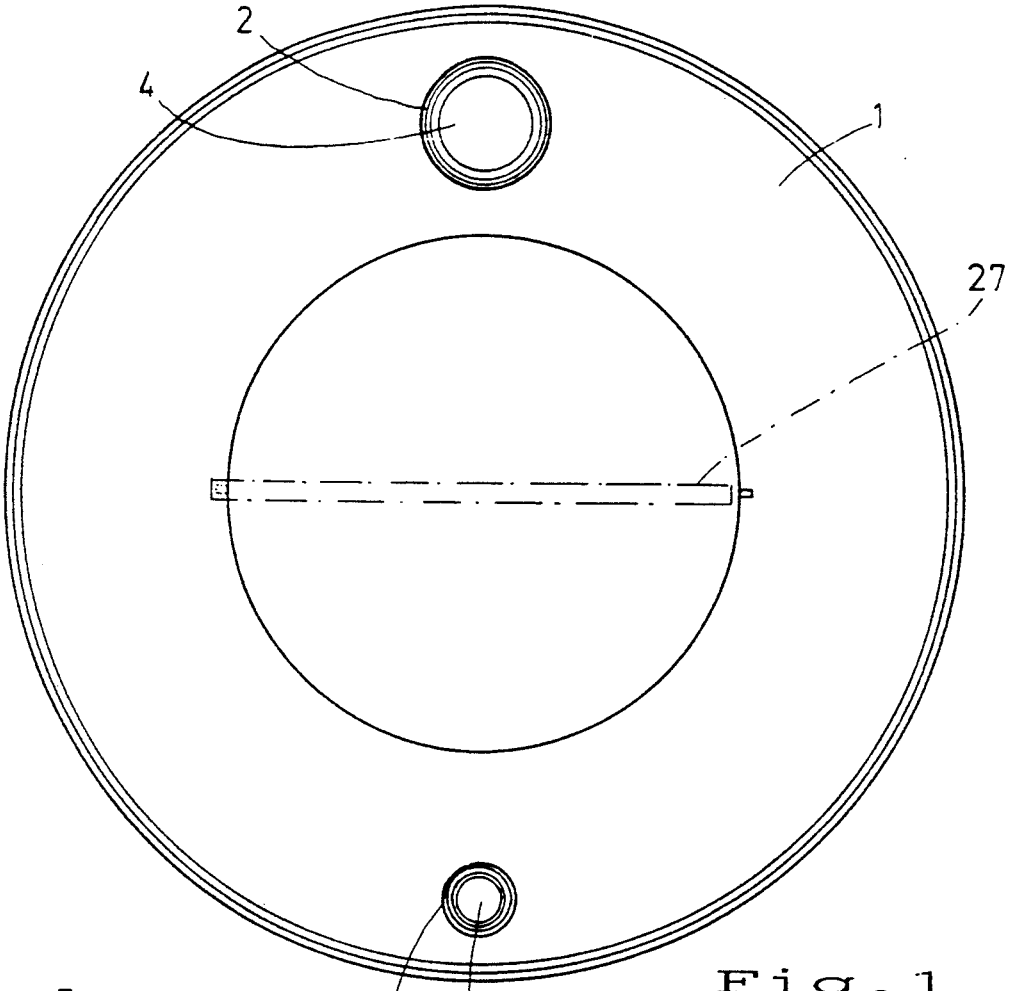

The invention relates to plastic lids for blow-molded, stackable bung and widemouthed barrels.

In bung and widemouth barrels, the shipping papers with the data regarding the filling material, intended for the customer, as well as shipping instructions are preferably attached to the bung lid and/or to the removable lid. Brief information is applied directly to the barrel lid with stick-on labels. Several shipping documents are suitably inserted in a plastic envelope which latter is glued to the lid. In case of widemouthed barrels, there is the possibility of packing the shipping papers with the material, the papers being suitably attached to the inside of the lid with or without insert casing. It is furthermore known to apply shipping documents to the barrel wall on the outside by means of a shrink film.

The conventional possibilities of mounting the shipping papers to the barrel and of enclosing the papers with the material are unsatisfactory. During transport, labels can be damaged so that the information printed thereon regarding the filling material are then only difficult to read, or even become illegible, and insert casings with the shipping papers, glued to the lids, can get lost. Applying the shipping papers to the inside of a lid for widemouthed barrels requires opening of the barrel for reading the shipping papers. This is cumbersome if the filling material is processed only at a later point in time. Furthermore, there is the danger that the shipping papers are damaged by liquid filling material and primarily by aggressive liquid filling material. If shipping papers are attached to the barrel wall by means of a shrink film, loss of the papers is to be feared in case the film tears during shipping of the barrels. Besides, the use of shrink films necessitates for the manufacturer of the filling material the provision of appropriate machines for applying the shrink film, and makes the reclaiming of the barrels more expensive due to the required removal of damaged film from the barrel wall. Reclaimed plastic barrels become furthermore less economical due to the removal of advertising labels that may be necessary when the filling material is changed and in case of possible use of reclaimed barrels at different manufacturing firms.

The invention is based on the object of developing a plastic lid for blow-molded bung and widemouthed barrels with a safe accommodation possibility for shipping documents and advertising material of all types.

A storage chamber integrated into the barrel lid ensures a safe accommodation of papers accompanying goods of all types, such as product specifications, delivery directions, usage plans for the barrel, information on reconditioning the barrel, environmental information, and advertising material. Furthermore, the chamber can house an inside liner of a synthetic resin film introduced into the barrel space prior to filling of the barrel in case of transporting and storing products problematic from a waste disposal viewpoint, such as dispersions, e.g. paints. Finally, a smaller quantity of a substance can be filled into the storage chamber which substance is admixed to the material contained in the barrel in order to produce a multicomponent material.

Figure 2:
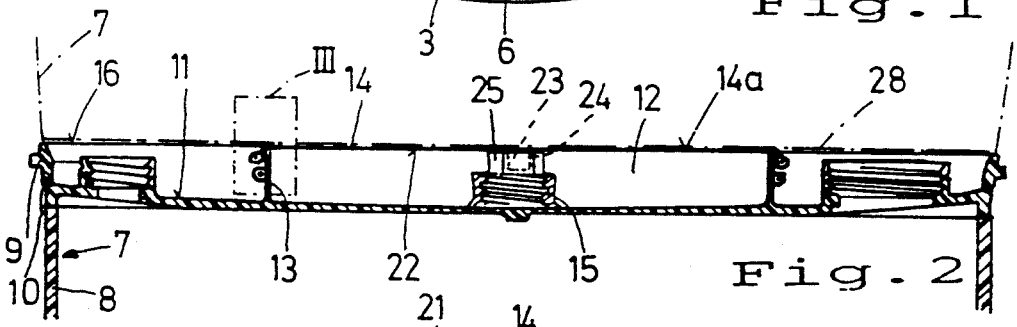
Figure 3:
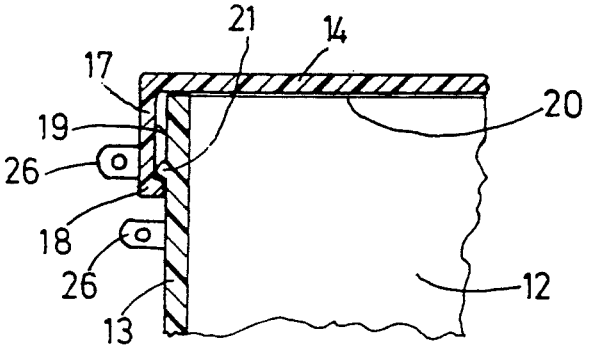
Figure 4:
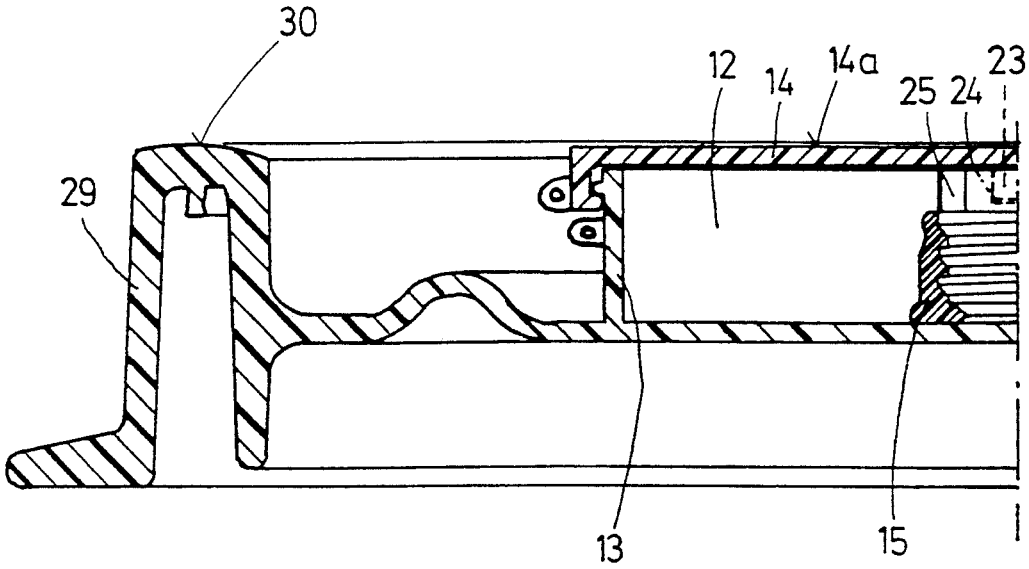
Figure 5:
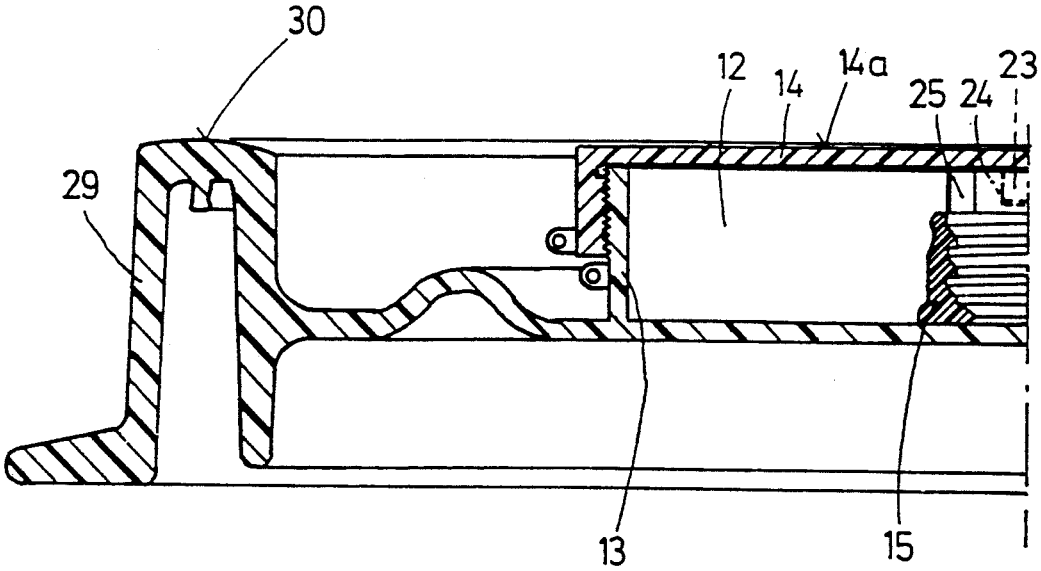

The invention with additional advantages will be described in greater detail below with reference to a bung barrel lid and a lid for a widemouthed barrel, illustrated in the drawing wherein:

FIG. 1 is a top view of a bung barrel lid,

FIG. 2 is a longitudinal section through the lid part of the bung barrel of FIG. 1 and the bottom part of a bung barrel stacked thereon, in an enlarged representation, FIG. 3 shows a detail of the bung barrel lid according to fragment III in FIG. 2, on an enlarged scale, FIG. 4 shows a removable lid for a widemouthed barrel in a sectional view, and FIG. 5 is a view similar to FIG. 4 but showing a modification thereof.

The bung barrel lid 1 injection-molded from a synthetic resin, in accordance with FIGS. 1–3, exhibits two diametrically opposed, integrally molded bungs 2, 3 adapted for a screw closure and forming bunghole openings 4, 6 which are sealed by means of appropriate screw plugs. The lid 1, welded over the circumference to the sidewall 8 of the bung barrel 7, has a supporting and transporting ring 9 projecting past the bungs 2, 3, with drainage openings 10 for rainwater distributed over the circumference.

On the outside 11 of the barrel lid 1, within the lid contour, a central storage chamber 12 is arranged designed as a flat cylindrical chamber with a wall 13 formed on the outside of the lid, a removable sealing lid 14, as well as with a blind bung 15 centrally attached to the barrel lid 1 for the centering and support of the chamber lid 14.

The sealing lid 14 of the storage chamber 12 of the bung barrel lid 1 terminates flush with the top rim 16 of the supporting and transporting ring 9 molded to the barrel lid.

The closing lid 14 of the storage chamber 12 produced as an injection-molded plastic part, is designed as a clamping lid extending with a radially inwardly oriented annular bead 18 molded to the lateral lid edge 17 over an annular web 21 formed at the outer rim 19 of the chamber wall 13 in the zone of the chamber opening 20, this closing lid engaging, by means of a peg 23 formed centrally on the inside 22 of the lid, into a centering bore 24 of a plug 25 threaded into the blind bung 15 of the barrel lid 1.

The sealing lid 14 of the storage chamber 12 is equipped with a master closure having respectively one or several eye or eyes 26, formed at the lateral rim 17 of the sealing lid 14 and at the outer circumference of the chamber wall 13; these eyes are joined in pairs by means of a lead seal or an embossed seal.

In a modification of the lid design described above, the sealing lid 14 of the storage chamber 12 can include a tear strip 27, shown in dot-dash lines in FIG. 1.

The closing lid 14 of the storage chamber 12 offers a surface for the application of advertising stickers. If the sealing lid 14 is designed as a see-through lid of a transparent plastic, there is the possibility to look into the storage chamber 12 without opening the lid 14.

When arranged in a stack, one bung barrel 7 is supported with its bottom 28 on the supporting and transport roller chime 9 and on the sealing lid 14 of the storage chamber 12 of the barrel lid 1 pertaining to the bung barrel 7 disposed therebelow. On account of the increased contact surface area due to the sealing lid 14 of the storage chamber 12, as compared with conventional barrel lids, a bung barrel 7 equipped with a lid 1 having a storage chamber 12 is distinguished by a substantially improved stacking safety.

Upon the occurrence of an internal excess pressure, the diaphragm-like lid 1, curving inwardly for residue emptying in the upended position of the barrel 7, is supported by way of the blind bung 15 as well as the wall 13 and the sealing lid 14 of the storage chamber 12 on the bottom 28 of the barrel 7 stacked on top thereof, so that the lid 1 is not subject to deformation forces with the possibility of damage, and the internal pressure forces are introduced directly into the barrel wall 8 and there act as tensile forces in the circumferential direction; such tensile forces can be compensated for in a specific zone without damage to the barrel wall.

The removable barrel lid 29 for widemouthed barrels according to FIG. 4 exhibits, in the same way as the bung barrel lid 1, a storage chamber 12 located within the lid contour, with a sealing lid 14 terminating flush with the upper lid rim 30.

In a modification of the described bung barrel lid design according to FIGS. 1–3, and of the lid 29 for widemouthed barrels according to FIG. 4, as shown in FIG. 5, the sealing lid 14 of the storage chamber 12 can be fashioned as a screw lid which is threaded with its lateral lid rim 17, provided with an internal thread, onto the opening rim of the chamber wall 13, provided with a corresponding outer thread, and is threaded by means of a threaded peg 23 molded to the inside 22 of the lid into a centering screw bore 24 of a plug 25 threaded into the blind bung 15 of the barrel lid 1, 29.

I claim:

1. A plastic lid for blow-molded stackable bung and widemouthed barrels of plastic, the lid having an upstanding peripheral rim and, spaced centrally within said rim, an upstanding wall having a closed contour, a removable sealing lid that coacts with an upper free edge of said wall to define between said sealing lid and said plastic lid a storage chamber, and a blind bung attached centrally to an upper side of said plastic lid for centering and supporting said sealing lid.

2. A plastic lid as claimed in claim 1, wherein said wall is cylindrical and of a diameter greater than its height.

3. A plastic lid according to claim 1, wherein said sealing lid has an upper surface that is coplanar with a free edge of said rim.

4. A plastic lid according to claim 1, wherein said sealing lid has a downwardly extending projection that engages in said blind bung.

5. A plastic lid as claimed in claim 1, wherein said wall has radially outwardly extending projection means and said sealing lid has radially inwardly extending projection means that engage under said radially outwardly extending means releasably to hold said sealing lid on said wall.

6. A plastic lid as claimed in claim 1, wherein said sealing lid and said wall have interengaging screw threads.

7. A plastic lid as claimed in claim 1, wherein said sealing lid has a downwardly depending flange and said downwardly depending flange and said wall have outwardly extending eyes for the reception of means releasably to join together said eyes thereby to hold said sealing lid on said wall.

8. A plastic lid as claimed in claim 1, wherein said sealing lid has a tear strip extending thereacross.

9. A lid as claimed in claim 1, wherein said plastic lid and said sealing lid are of injection molded plastic.

10. A plastic lid as claimed in claim 1, wherein said sealing lid is transparent.

* * * * *